US007392640B2

(12) United States Patent
Vasquali

(10) Patent No.: US 7,392,640 B2
(45) Date of Patent: Jul. 1, 2008

(54) AUTOMATIC MACHINE FOR COUNTING AND FEEDING ARTICLES, IN PARTICULAR TABLETS, CAPSULES, PILLS

(75) Inventor: Fabio Vasquali, Muggio (IT)

(73) Assignee: Tonazzi Vasquali S.r.l., Cerro Maggiore (Milan) (IT)

( * ) Notice: Subject to any disclaimer, the term of this patent is extended or adjusted under 35 U.S.C. 154(b) by 0 days.

(21) Appl. No.: 11/695,150

(22) Filed: Apr. 2, 2007

(65) Prior Publication Data

US 2007/0235464 A1 Oct. 11, 2007

(30) Foreign Application Priority Data

Apr. 7, 2006 (IT) ..... BO2006A0262

(51) Int. Cl.
*B65B 1/30* (2006.01)
*B65B 57/20* (2006.01)

(52) U.S. Cl. ..... 53/498; 53/494; 53/247; 221/265

(58) Field of Classification Search ..... 53/52, 53/493, 494, 495, 498, 499, 247, 255; 221/247, 221/265

See application file for complete search history.

(56) References Cited

U.S. PATENT DOCUMENTS 453,873 A * 6/1891 Upjohn ..... 221/265
964,782 A * 7/1910 Hull ..... 221/265
2,507,883 A * 5/1950 Stanley ..... 53/244
2,515,594 A * 7/1950 Fischman ..... 221/265
2,742,184 A * 4/1956 Yerkes et al. ..... 53/244
2,801,025 A * 7/1957 Cookson et al. ..... 221/265
3,281,012 A * 10/1966 Martell ..... 221/265
3,628,694 A * 12/1971 Nichols ..... 221/265
3,722,740 A * 3/1973 List ..... 221/265
3,955,336 A * 5/1976 Fern et al. ..... 53/493
3,978,641 A * 9/1976 Tollefsbol ..... 53/493
5,058,766 A * 10/1991 Deckler ..... 221/254
5,086,945 A * 2/1992 Corella ..... 221/265

* cited by examiner

*Primary Examiner*—Louis K Huynh
(74) *Attorney, Agent, or Firm*—William J. Sapone; Coleman Sudol Sapone P.C.

(57) ABSTRACT

In a counting machine, a feeding tray contains articles in bulk to supply the articles to a rotating disc-shaped support with a plurality of through holes. A check station has a transparent plate operating to keep the articles in the holes and cooperating with vision devices provided for checking integrity and presence of articles in the through holes A rejection station has plurality of wings to keep/release articles into/from respective through holes according to signals coming from the vision devices. Also a discharge station has a plurality of wings to release/keep articles from/into respective through holes, according to signals coming from the vision devices.

20 Claims, 7 Drawing Sheets

4
6
62
61
S1
6a
60

7
3
3*
5
VI
VI
70
V
V
5
70
S2

FIG. 5
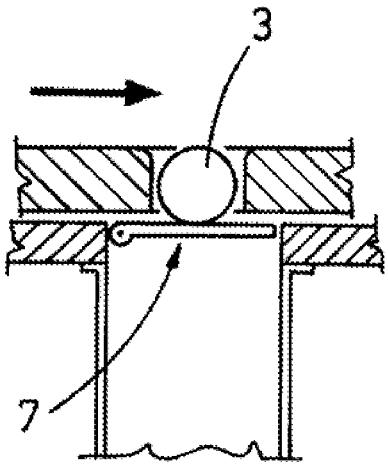
FIG. 6
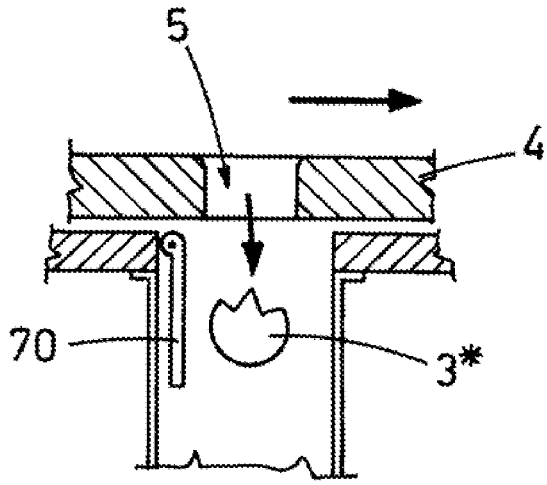
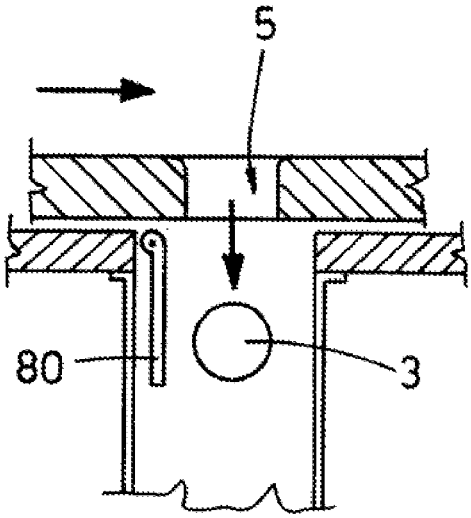
FIG. 8
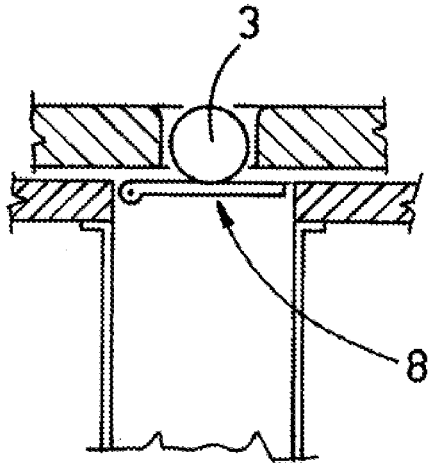
FIG. 9

AUTOMATIC MACHINE FOR COUNTING AND FEEDING ARTICLES, IN PARTICULAR TABLETS, CAPSULES, PILLS

FIELD OF THE INVENTION

The present invention relates to automatic packaging of articles into bottles and/or containers.

In particular, the invention relates to an automatic machine for counting and feeding articles, which are to be introduced into bottles and/or containers.

DESCRIPTION OF THE PRIOR ART

Automatic machines for counting articles of known type, so-called counting machines, are divided substantially in two different types: electronic and mechanical.

The electronic counting machines have a hopper, containing articles in bulk and cooperating with vibrating planes with a series of channels through which the articles are moved to a filling station in an orderly way.

This type of counting machines have optical systems, including e.g. telecameras, which are capable of controlling the quality (validation) and the quantity (counting) of the articles, which are sent to the bottle/s dwelling in the filling station.

Articles, whose quality is not acceptable (for example broken, deformed, etc.) are removed in a known way, upstream of the filling station.

The main drawbacks of the electronic counting machines derive from their high production cost and considerable dimensions.

In this respect, the extension of the vibrating planes is connected to the necessity of sending correctly the articles into the channels, whose number depends on the bottle filling speed, that is the rapidity, with which the bottles follow one another in the filling station.

Not less significant is the problem deriving from the difficult sanitization process, characterizing this type of machines due to the big number of components used.

The mechanical counting machines also have a hopper, containing articles in bulk and cooperating with an inclined, rotating disc, which features, along its periphery, a series of holes, each of which is capable of receiving a plurality of articles.

The lower part of the rotating disc interacts with a filling station, where the peripheral holes discharge the articles into the bottle/s which is/are dwelling below.

The quantity of articles present in each bottle (counting) is measured by the difference between the bottle weight before and after its filling.

In spite of their contained costs and reduced dimensions, the mechanical counting machines are characterized by a drawback resulting from the fact that they do not allow the quality control (validation) of the articles introduced into the bottles.

In this case, the bottles containing articles, whose quality is not acceptable (for example broken, deformed, etc.) are not in fact identified and thus they are accepted instead of being rejected and it is necessary to use other devices (e.g. scales) for finding them out.

SUMMARY OF THE INVENTION

The object of the present invention is to propose an automatic machine for counting articles, the so called counting machine, which is capable of controlling the quality and quantity of the treated articles, ensuring at the same time particularly low production costs and extremely reduced dimensions.

Another object of the present invention is to propose a counting machine, which is capable of ensuring extremely rapid and intuitive installation, maintenance and handling operations.

A further object of the present invention is to propose an extremely functional and reliable counting machine, which allows high production rate and flexibility standards.

The above mentioned objects are obtained, in accordance with the contents of the claims, by an automatic machine for counting articles, in particular tablets, capsules, pills, including:

a feeding tray containing articles in bulk open at bottom;

a rotating disc-shaped support for closing said feeding tray at bottom, with a plurality of through holes made in sad disc-shaped support for receiving at least one single article from the feeding tray in each through hole;

retaining means connected to said disc-shaped support for keeping the articles within the respective through holes;

a check station, situated downstream of the feeding tray and provided with first support means operating therein to keep the articles in the respective holes, and cooperating with first optical means for verifying the integrity and the presence of the articles in each hole of the disc-shaped support;

a rejection station situated downstream of the check station and provided with second support means for keeping the articles in the respective holes and for allowing the articles to leave the respective holes according to signals coming from the first optical means, concerning the integrity of the articles;

a discharge station situated downstream of the rejection station and provided with third support means for allowing the articles to be released into containers dwelling below, and for keeping the articles in the holes according to signals coming from the first optical means concerning the integrity and/or presence of articles in the respective holes.

BRIEF DESCRIPTION OF THE DRAWINGS

The characteristic features of the invention are pointed out in the following description of some preferred but not exclusive embodiments, with reference to the enclosed figures, in which:

FIGS. 5, 6 are section views, taken along the V-V and VI-VI of FIG. 4;

FIGS. 8, 9 are as many section views, taken along the VIII-VIII and-IX-IX of FIGS. 7A, 7B;

DISCLOSURE OF THE PREFERRED EMBODIMENT

Figure 1:
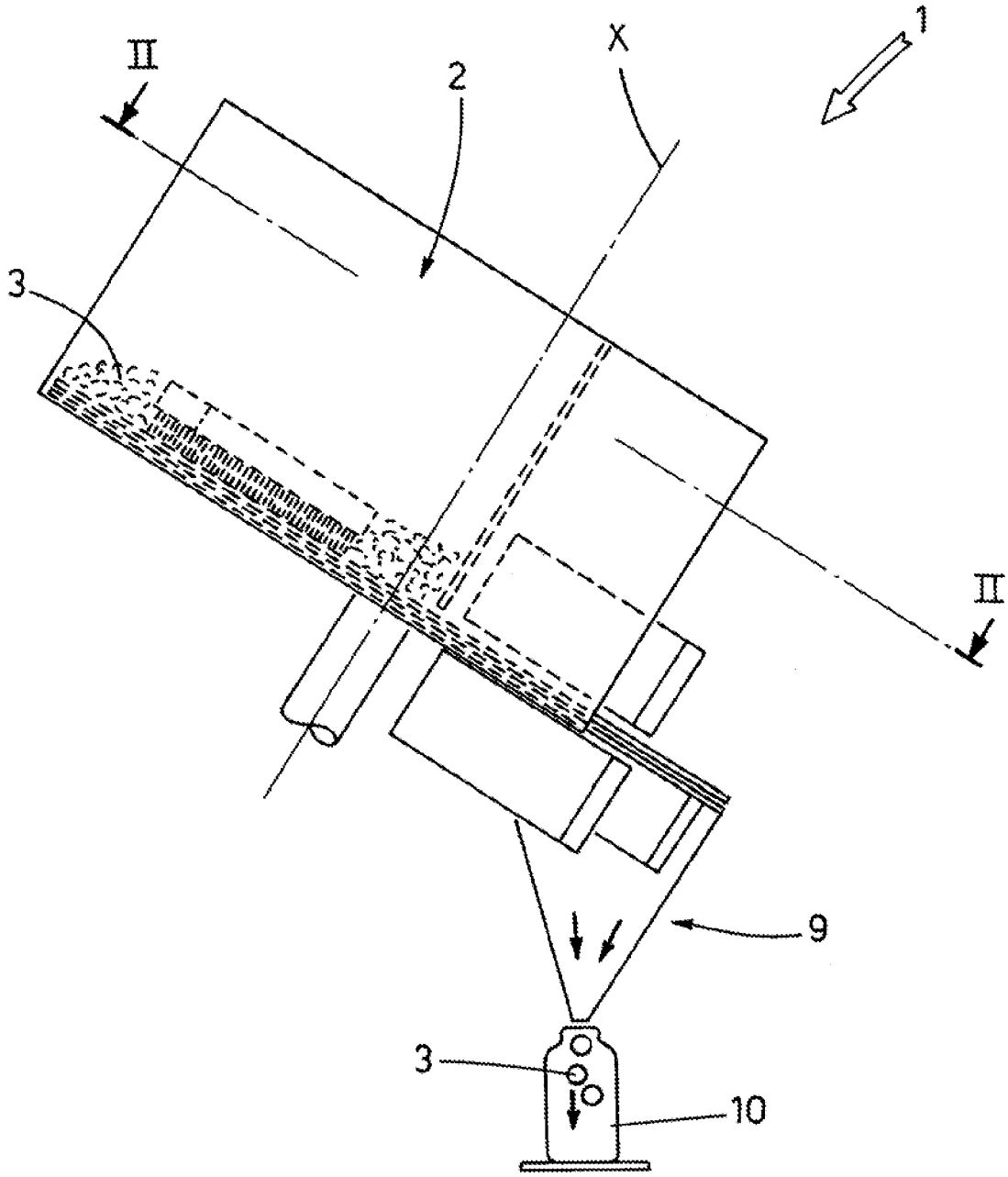
FIG. 1 is a lateral view of the proposed counting machine.

Having regard to the above figures, the general reference numeral 1 indicates the proposed automatic machine for counting articles 3, the so called counting machine, including a feeding tray 2, which carries articles 3 in bulk, and having a lower part closed by a rotating, disc-shaped support 4.

The support 4 has a plurality of through holes 5, each of which being capable of receiving one article 3 coming from the feeding tray 2.

The lower part of the disc-shaped support 4, preferably having an axis X inclined with respect to the vertical, faces a motionless disc-shaped plate 40, which keeps the articles 3, preferably tablets, capsules, pills, inside the respective holes 5 while being moved.

According to a preferred embodiment, the through holes 5, made in the rotating disc-shaped support 4, are grouped in radial sections F1, F2, F3, F4.

Figure 2:
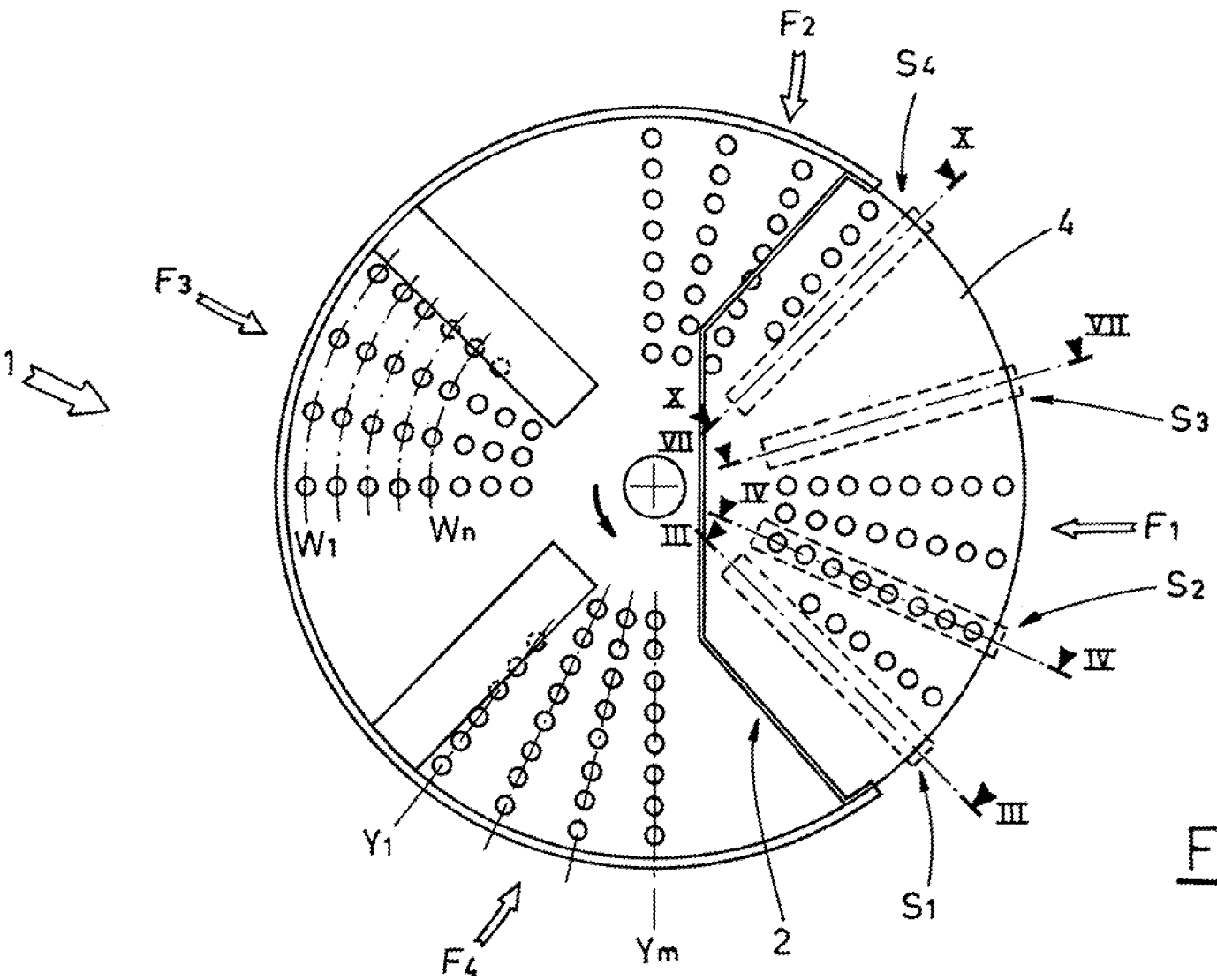
FIG. 2 is a section view, taken along the II-II of FIG. 1.

The holes 5 in each of the radial section are placed side by side along concentric circumferences $W_1, \ldots, W_n$ and aligned in radial direction $Y_1, Y_m$, as indicated in FIG. 2.

Figure 7A:
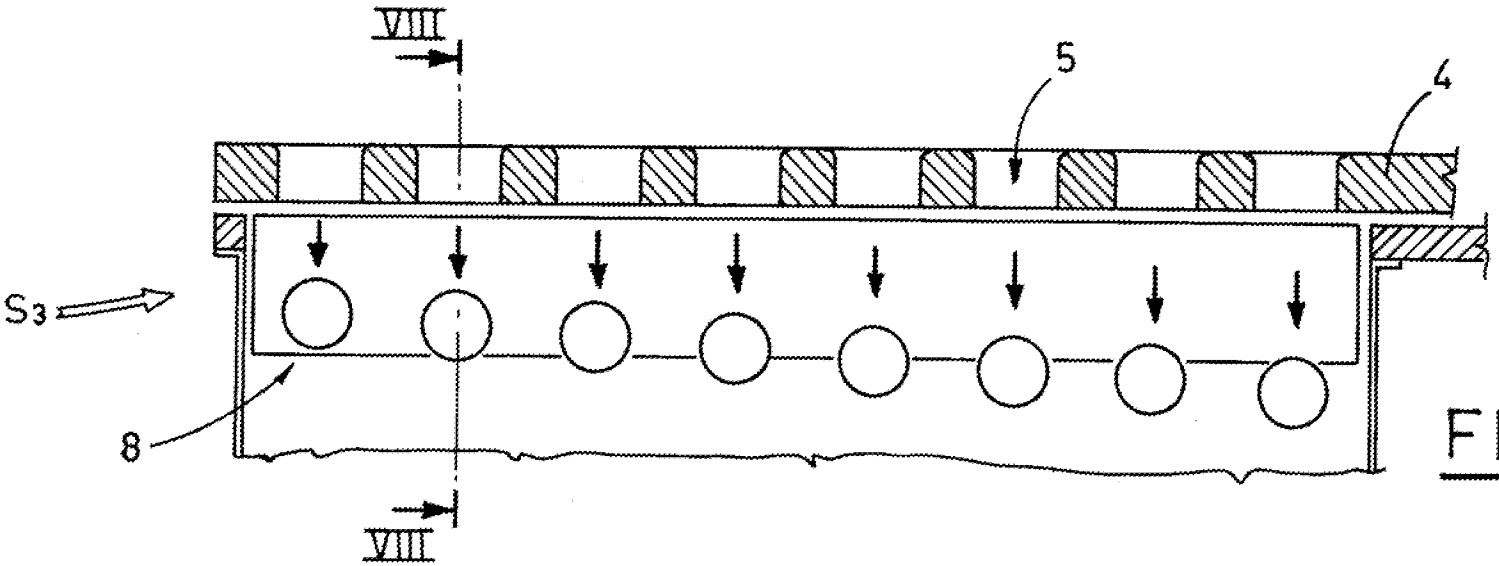
FIGS. 7A, 7B are section views, taken along the VII-VII of FIG. 2 in two different work steps.
Figure 7B:
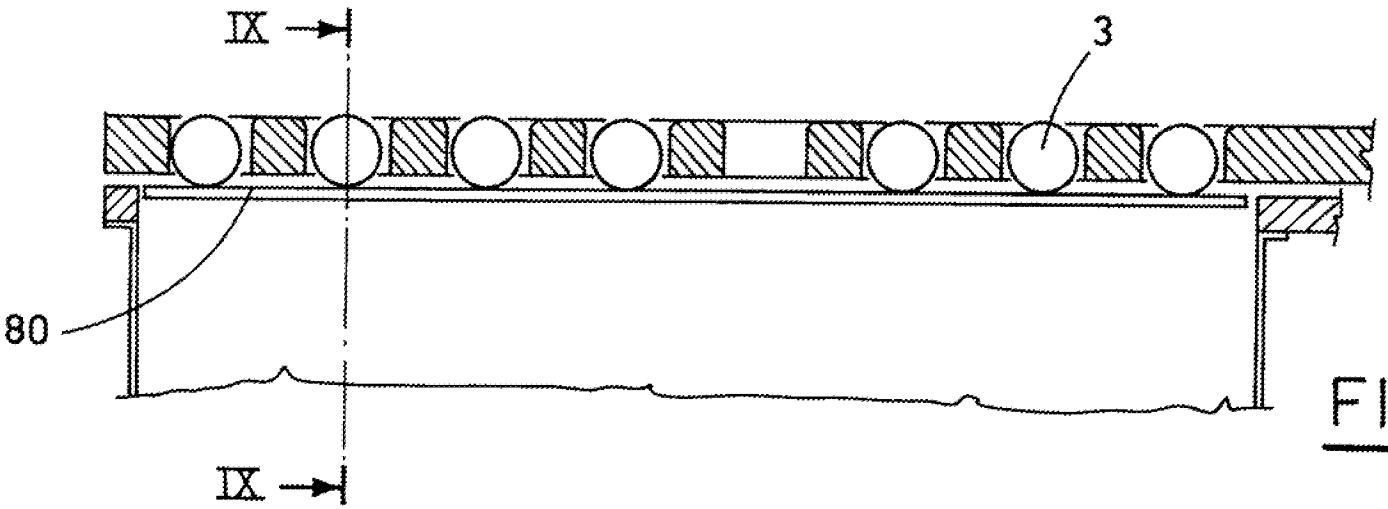

With particular reference to FIG. 2, the proposed counting machine 1 includes advantageously:

- a check station S1, which is situated downstream of the feeding tray 2, and in which first support means 6 operate, to keep the articles 3 inside the respective holes 5, and cooperate with first optical means 60 aimed at verifying the integrity and presence of the articles 3 inside each hole 5 (FIG. 3);
- a rejection station S2, situated downstream of the check station S1, in which second support means 7 operate, to keep/release the articles 3 inside/from the respective holes 5, according to the signals coming from the first optical means 60 (FIG. 4);
- a discharge station S3, situated downstream of the rejection station S2, in which third support means 8 operate, to release/keep the articles 3 from/inside the respective holes 5, according to the signals coming from the first optical means 60 (FIGS. 7A, 7B).

The number of through holes 5 for each radial section F1, F2, F3, F4 is preferably equal to the number of articles 3, which can fill a container 10.

Figure 3:
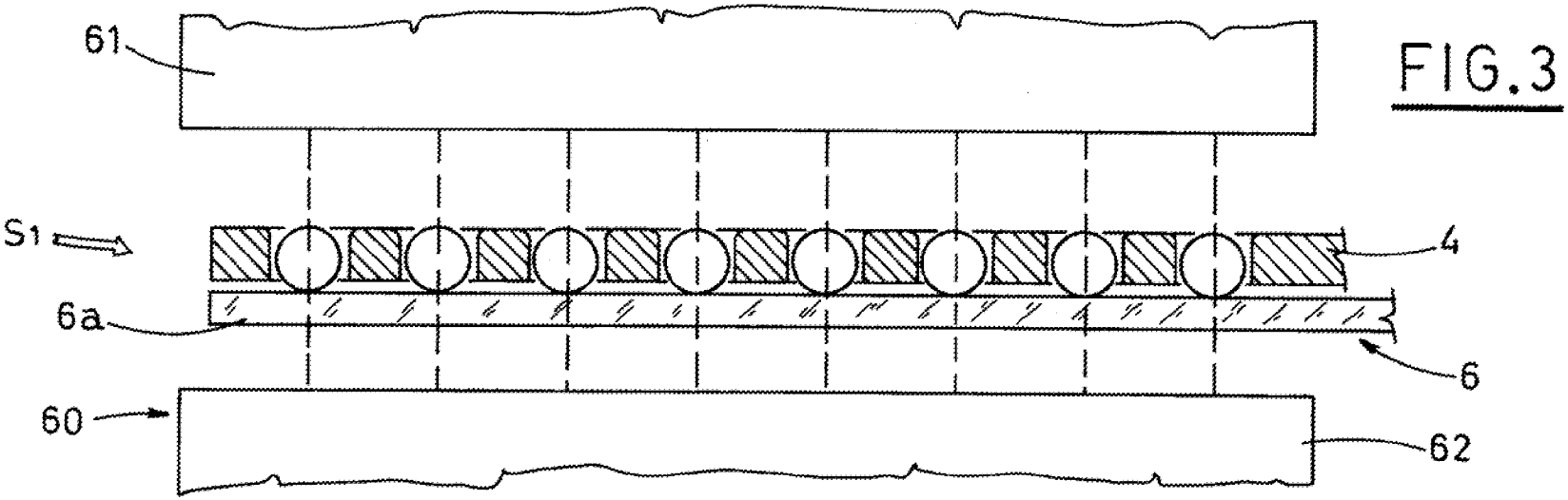
FIG. 3 is a section view, taken along the III-III of FIG. 2.
Figure 4:
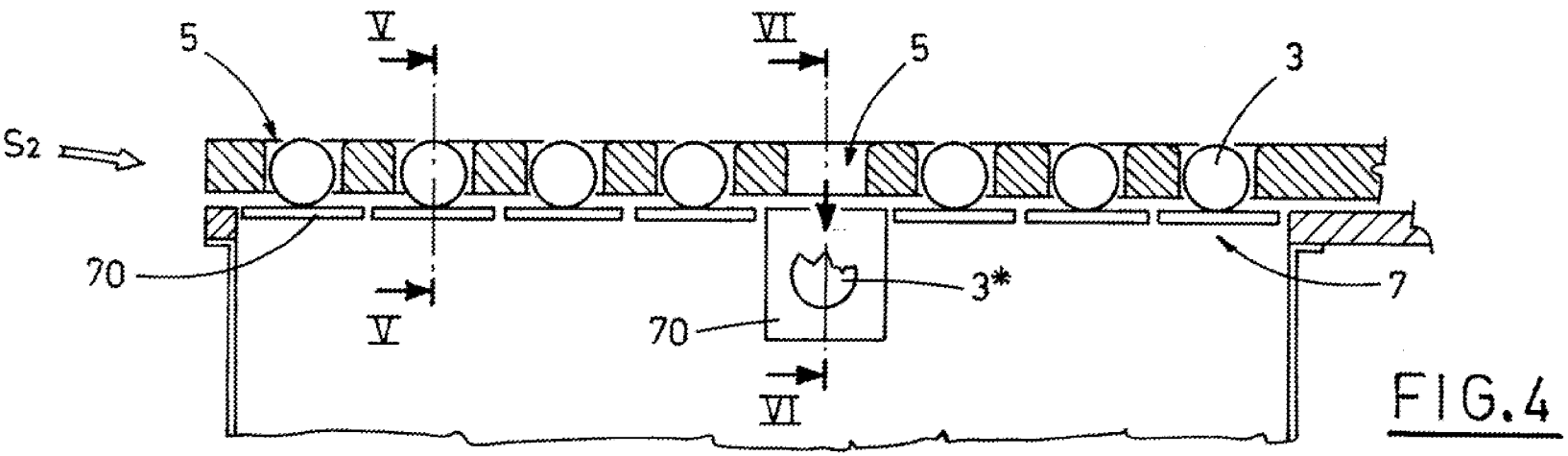
FIG. 4 is a section view, taken along the IV-IV of FIG. 2.

The first support means 6, which operate in the check station S1, include advantageously a plate 6*a*, made of transparent, antistatic material, e.g. glass, interposed between the vision means, upper 61 and lower 62, defining the first optical means 60, to allow inspection of the integrity and presence of the articles 3 inside each hole 5 (FIG. 3).

The second support means 7, which operate in the rejection station S2, usually aimed at keeping the articles 3 inside the respective holes 5, are also able to allow the same articles 3 to leave the corresponding holes 5, according to the signals coming from the first optical means 60, concerning the article 3 integrity.

For example, the second support means 7 include a plurality of first wings 70, connected to the bottom of the corresponding through holes 5 and operated to allow the opening and/or closing of the holes 5, by first operation means (not shown in FIG. 4), for example pneumatic, independent from each other.

The third support means 8, which operate in the discharge station S3, normally aimed at releasing the articles 3 into the containers 10 dwelling below (FIG. 7A), are also able to keep the same articles 3 in the holes 5 (FIG. 7B), according to the signals coming from the first optical means 60 concerning the integrity and/or the presence of the articles 3 in the respective holes 5.

For example, the third support means 8 include a support plate 80, connected to the bottom of the plurality of the through holes 5 and operated to allow the opening and/or closing of the holes 5, by second operation means (not shown in FIGS. 7A, 7B), for example pneumatic, operated in synchrony.

According to another embodiment (not shown), the third support means 8 can include a plurality of second wings, connected to the bottom of the corresponding through hole 5 and operated to allow the opening and/or closing of the holes 5, by second operation means, for example pneumatic, independent from each other.

Figure 10A:
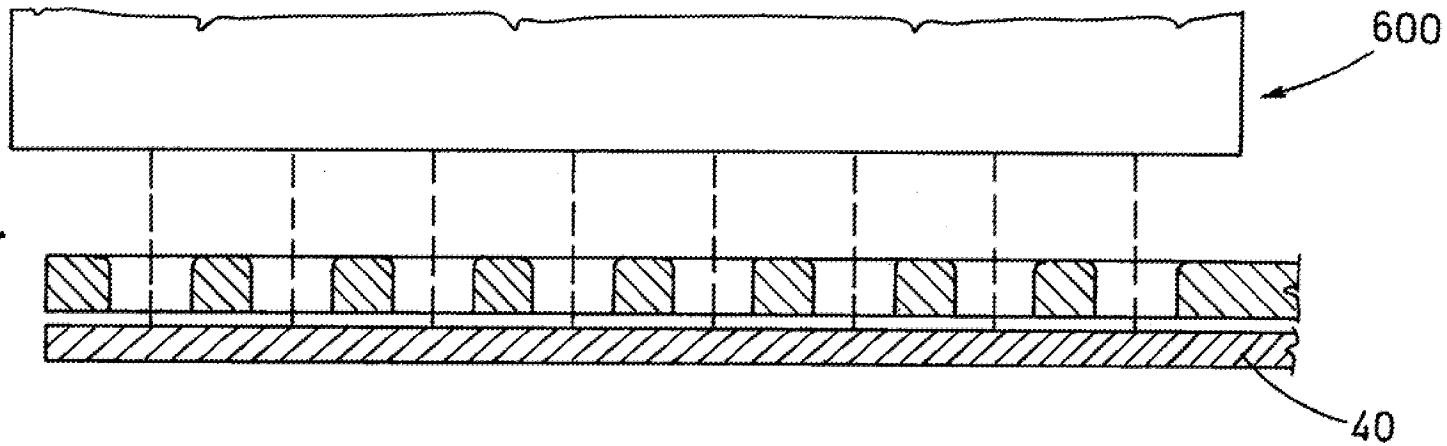
FIGS. 10A, 10B are section views, taken along the X-X of FIG. 2, in two different work steps.
Figure 10B:
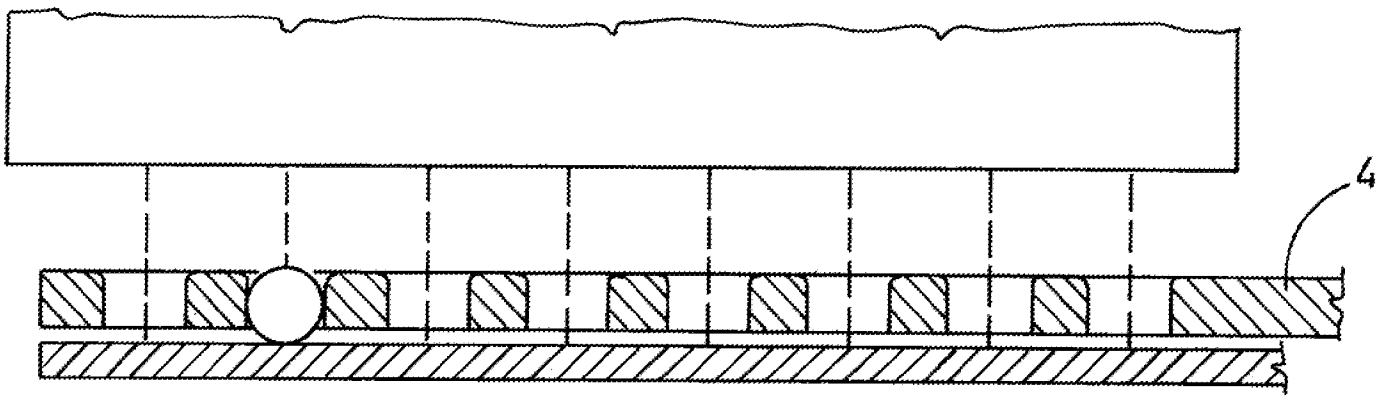

With particular reference to FIG. 2, the proposed counting machine 1 includes also a verify station S4 (FIGS. 10A, 10B), situated downstream of the discharge station S3, in which second optical means 600 operate to detect the presence, or find out the absence, of the articles 3 in the respective holes 5, so as to allow the acceptation/rejection of the above mentioned containers 10.

The counting machine 1 includes advantageously guiding means 9, operating in the discharge station S3, which allow the articles 3 released by the third support means 8 to be conveyed and/or accumulated.

The guiding means 9 cooperate with closing means 90, 91, which are able to define at least one chamber A, B to accumulate a selected number of articles 3, released by the third support means 8, so as to allow the succession of subsequent containers 10, without affecting the production rate of the machine 1.

Figure 11B:
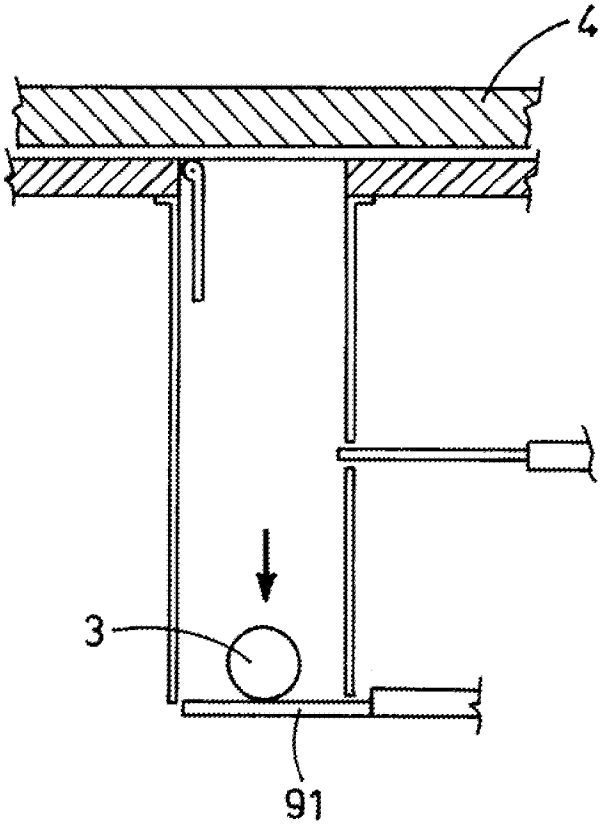
FIGS. 11A, 11B are as many section views, taken along the VIII-VIII of FIG. 7A, in two subsequent work steps, referred to a different embodiment.
Figure 11A:
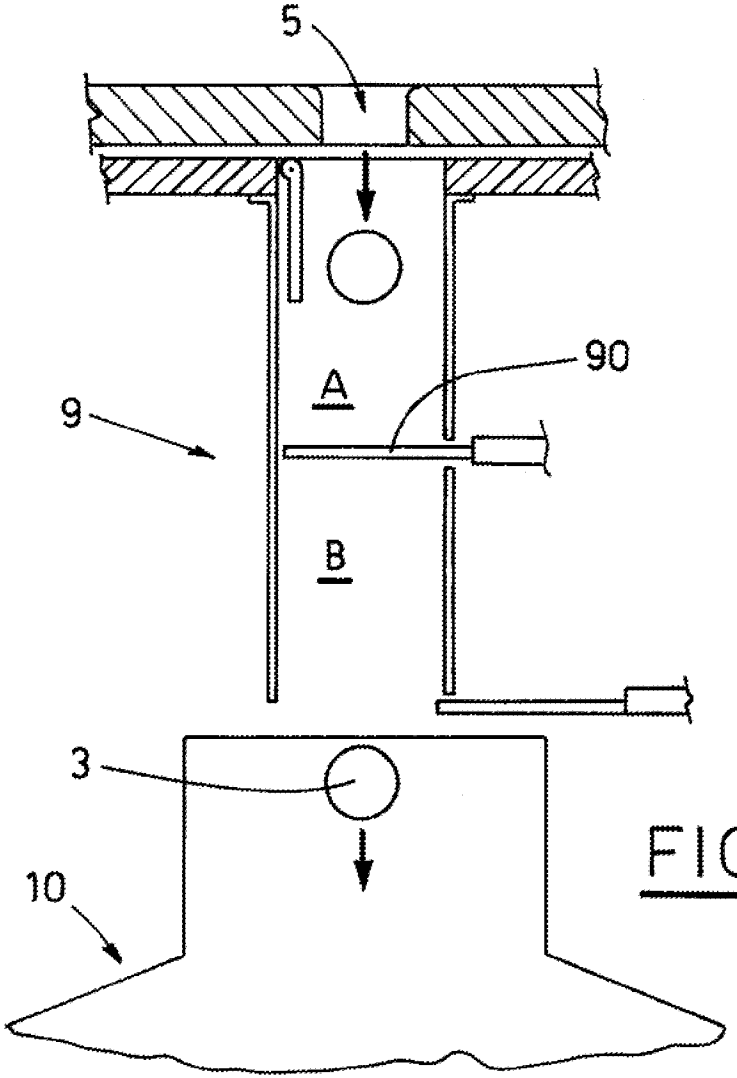

With particular reference to FIGS. 11A, 11B, the guiding means 9 include channels, having the shape of a funnel and cooperating with a pair of closing separators, upper 90 and lower 91, operated in known way, to define a pair of accumulation chambers, upper A and lower B.

Having one or more accumulation chambers A, B allows the discharge station S3 to release normally the articles 3, even if no container 10 is dwelling below.

For example, more precisely, the upper accumulation chamber A can store the articles 3 released by the third support means 8, while waiting for a container 10 to be positioned below.

In case of further delay of the container 10 below, the lower accumulation chamber B is likewise able to store the articles 3 released by the upper chamber A, situated above. Thus, the presence of the accumulation chambers A, B, connected to the discharge station S3, allows to use a disc-shaped support 4, which has through holes 5 gathered in more radial sections F1, F2, F3, F4 and/or closer to each other (FIG. 2).

In the following, the operation of the proposed counting machine 1 will be described briefly, taking into consideration each through hole 5 of a section F1, F2, F3, F4, which leaves the feeding tray 2 containing a respective article 3, with the stations S1, S2, S3, S4 treating in a sequence one or more radial rows of holes 5.

The articles 3 in the check station S1 are kept in the respective holes 5 by the transparent plate 6*a*, thus allowing the first optical means 60 to check the integrity and the presence of the articles 3 inside each hole 5 (FIG. 3).

The articles 3 in the rejection station S2 are normally kept inside the respective holes 5 by the corresponding first wings 70, unless the first optical means 60 have previously detected the presence of articles 3* of unacceptable quality (broken, deformed, etc.).

In this case the corresponding first wings 70 are operated to release the unacceptable articles 3*.

According to a preferred embodiment, the support plate 80 in the discharge station S3 normally allows the articles 3 to be released into the first element 10 dwelling below, or into the accumulation chambers A, B.

Otherwise, in case of the two types of anomalies described in the following, the support plate 80 keeps all the articles 3 inside the holes 5, which consequently return to the feeding tray 2.

The first type of anomaly is the detection, by the first optical means 60, of one or more articles 3* of unacceptable quality, which are not kept in the holes 5 in the rejection station S2.

The second type of anomaly is the absence of one or more articles 3* which are not detected by the first optical means 60 in the respective hole/s 5.

Otherwise, according to a further embodiment, the third support means 8 include a plurality of second wings (not shown) and in case of anomaly (empty hole/s 5 caused by the absence of article 3 or by the rejection of an unacceptable article 3*), the latter are operated to release only acceptable articles 3.

In this case, the holes 5, which are possibly empty due to the above reasons, do not keep all the articles 3 in the holes 5 and do not cause their subsequent return to the feeding tray 2.

In this case, each upper closing separator 90, situated below each hole 5 of the disc-shaped support 4 can be operated in an autonomous way, enabled by the first control optical means 60.

The acceptable articles present in the holes 5 of the disc-shaped support 4 are always transferred into the upper accumulation chamber A, and then transferred to the lower accumulation chamber B, so as to reach the required counting.

When the counting has been completed, the lower closing separator 91 releases the articles into the container 10 below.

In this regard, the accumulation chambers A, B, in which a prefixed number of articles 3 is stored before being released into the containers 10, are particularly advantageous.

No matter of what the operation mode is, the second optical means 600, operating in the verify station S4, verify the presence or absence of the articles 3 in the respective holes 5, in order to prevent possible non-releases, so as to allow acceptance/rejection of the containers 10 being processed.

It is easily understood from the above description that the proposed automatic machine for counting articles allows to control the quantity and the quality of the articles being processed, ensuring at the same time particularly reduced production costs and the extremely limited dimensions.

The counting machine proposed by the invention is formed by a limited number of elements, which allows to perform extremely rapid and intuitive installation, maintenance and handling operations.

In this regard, it is to be pointed out that the sanitization and/or sterilization of the proposed counting machine, in particular of its components, are simple and rapid.

It is understood that the proposed invention has been described, with reference to the enclosed figures, as a mere, not limiting example. Therefore, it is obvious that any changes or variants applied thereto remain within the protective scope defined by the following claims.

What is claimed is:

1. An automatic machine for counting articles, in particular tablets, capsules, pills, including:

a feeding tray containing articles in bulk open at bottom;

a rotating disc-shaped support for closing said feeding tray at bottom, with a plurality of through holes made in sad disc-shaped support for receiving at least one single article from the feeding tray in each through hole;

retaining means connected to said disc-shaped support for keeping the articles within the respective through holes;

a check station, situated downstream of the feeding tray and provided with first support means operating therein to keep the articles in the respective holes, and cooperating with first optical means for verifying the integrity and the presence of the articles in each hole of the disc-shaped support;

a rejection station situated downstream of the check station and provided with second support means for keeping the articles in the respective holes and for allowing the articles to leave the respective holes according to signals coming from the first optical means, concerning the integrity of the articles;

a discharge station situated downstream of the rejection station and provided with third support means for allowing the articles to be released into containers dwelling below, and for keeping the articles in the holes according to signals coming from the first optical means concerning the integrity and/or presence of articles in the respective holes.

2. A machine according to claim 1, including a verify station situated downstream of the discharge station and equipped with second optical means for detecting the presence of the articles in the respective holes, in time relation with operation of the third support means, to allow acceptance/rejection of said containers.

3. A machine according to claim 1, including guiding means operating in the discharge station to allow conveying and/or accumulation of articles released by the third support means.

4. A machine according to claim 3, including closing means connected to said guiding means and defining at least one accumulation chamber for articles released by the third support means.

5. A machine according to claim 1, wherein said through holes are gathered in radial sections, with the holes in each section of said radial section placed side by side along concentric rings and aligned in radial direction.

6. A machine according to claim 5, wherein the number of through holes for each radial section is equal to the number of articles selected to fill at least one container.

7. A machine according to claim 1, wherein the first support means, operating in the check station, include a plate of transparent material, preferably antistatic, interposed between upper vision means and lower vision means defining said first optical means, for checking integrity and presence of articles in each through hole.

8. A machine according to claim 1, wherein the second support means, operating in the rejection station, include a plurality of first wings, each of which connected to a through hole and operated by first actuating means to open/close, respectively to release/keep articles contained in the through holes, according to signals coming from the first optical means, operating in the check station.

9. A machine according to claim 8, wherein said first actuating means are operated pneumatically.

10. A machine according to claim 1, wherein said third support means, operating in the discharge station, include a support plate, connected to a plurality of through holes and operated by second actuating means to open/close, respectively to release/keep articles contained in the through holes according to signals coming from the first optical means, operating in the check station.

11. A machine, according to claim 10, wherein said second actuating means are operated pneumatically.

12. A machine, according to claim 1, wherein third support means, operating in the discharge station, include a plurality of second wings connected to said through holes and operated by second actuating means to open/close, respectively to release/keep articles contained in the through holes, according to signals coming from the first optical means, operating in the check station.

13. A machine according to claim 1, wherein said check means connected to the disc-shaped support, include a motionless disc-shaped plate geometrically similar to said disc-shaped support.

14. A machine according to claim 1, wherein the rotating disc-shaped support has axis inclined.

15. A machine according to claim 1, including:

a verify station situated downstream of the discharge station and equipped with second optical means for detecting the presence of the articles in the respective holes, in time relation with operation of the third support means, to allow acceptance/rejection of said containers;

guiding means operating in the discharge station to allow conveying and/or accumulation of articles released by the third support means;

closing means connected to said guiding means and defining at least one accumulation chamber for articles released by the third support means;

and wherein:

the first support means, operating in the check station, include a plate of transparent material, preferably antistatic, interposed between upper vision means and lower vision means defining said first optical means, for checking integrity and presence of articles in each through hole;

the second support means, operating in the rejection station, include a plurality of first wings, each of which connected to a through hole and operated by first actuating means to open/close, respectively to release/keep articles contained in the through holes, according to signals coming from the first optical means, operating in the check station, said third support means, operating in the discharge station, include a support plate, connected to a plurality of through holes and operated by second actuating means to open/close, respectively to release/keep articles contained in the through holes according to signals coming from the first optical means, operating in the check station;

third support means, operating in the discharge station, include a plurality of second wings connected to said through holes and operated by second actuating means to open/close, respectively to release/keep articles contained in the through holes, according to signals coming from the first optical means, operating in the check station;

said check means connected to the disc-shaped support, include a motionless disc-shaped plate geometrically similar to said disc-shaped support.

16. A machine according to claim 15, wherein the rotating disc-shaped support has axis inclined.

17. A machine according to claim 15, wherein said through holes are gathered in radial sections, with the holes in each section of said radial section placed side by side along concentric rings and aligned in radial direction.

18. A machine according to claim 17, wherein the number of through holes for each radial section is equal to the number of articles selected to fill at least one container.

19. A machine according to claim 15, wherein said first actuating means are operated pneumatically.

20. A machine, according to claim 15, wherein said second actuating means are operated pneumatically.

* * * * *